US006244913B1

(12) United States Patent
Matsumoto et al.

(10) Patent No.: US 6,244,913 B1
(45) Date of Patent: Jun. 12, 2001

(54) PROPULSION UNIT ASSEMBLY FOR PERSONAL WATERCRAFT

(75) Inventors: Chihiro Matsumoto; Mitsuhisa Hirano; Makoto Nagafusa, all of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/330,752

(22) Filed: Jun. 11, 1999

(30) Foreign Application Priority Data

Jun. 11, 1998 (JP) ..... 10-163921
Jun. 11, 1998 (JP) ..... 10-163931
Oct. 21, 1998 (JP) ..... 10-300163
Oct. 21, 1998 (JP) ..... 10-300171

(51) Int. Cl.[7] ..... B63H 11/00
(52) U.S. Cl. ..... 440/38; 440/40; 114/55.5; 114/55.51
(58) Field of Search ..... 440/38, 40, 41, 440/42, 43, 88; 60/221, 222; 114/55.5, 55.51, 55.52, 55.53, 55.54, 55.55, 55.56, 55.57, 55.58

(56) References Cited

U.S. PATENT DOCUMENTS 2,466,525 * 4/1949 Wilson ..... 165/282
3,089,454 5/1963 Chronic .
3,623,447 * 11/1971 Jacobson ..... 114/55.51
3,982,497 9/1976 Caron .
5,151,057 * 9/1992 Kobayashi et al. ..... 440/38
5,254,024 * 10/1993 Kobayashi et al. ..... 440/42
5,401,198 3/1995 Toyohara et al. .
5,421,753 * 6/1995 Roos ..... 440/43
5,460,553 * 10/1995 Craig et al. ..... 440/38
5,472,359 * 12/1995 Allbright, Jr. et al. ..... 440/38
5,490,804 * 2/1996 Blanchard et al. ..... 440/38
5,494,464 2/1996 Kobayashi et al. .
5,713,769 * 2/1998 Jones ..... 440/38
5,752,863 * 5/1998 Baker et al. ..... 440/38
5,800,222 * 9/1998 Nanami ..... 440/38
5,876,258 * 3/1999 Gray ..... 440/46
6,022,250 * 2/2000 Futaki et al. ..... 440/38

FOREIGN PATENT DOCUMENTS

405229485 * 9/1993 (JP) ..... 440/35

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A propulsion unit assembly for a personal watercraft provides for the quick and easy alignment of a propulsion device of the assembly relative to the longitudinal axis of the watercraft when mounting the propulsion device on the hull of the watercraft. The mounting arrangement includes a mounting plate having stoppers which cooperate with bosses formed on the front wall of the tunnel of the watercraft to properly align the mounting plate before fixing the plate to the hull and mounting the propulsion device thereto. In addition, the disclosed propulsion unit assembly includes an integrally formed cooling water supply system which utilizes the existing high-capacity jet pump unit to provide pressurized cooling water for cooling of the engine and associated watercraft components.

36 Claims, 15 Drawing Sheets

PROPULSION UNIT ASSEMBLY FOR PERSONAL WATERCRAFT

BACKGROUND OF THE INVENTION

1. Field of the Invention

The present invention generally relates to the propulsion and cooling systems for a personal watercraft. More particularly, the present invention relates to a propulsion unit assembly for a personal watercraft.

2. Description of the Related Art

Personal watercraft have become very popular in recent years. This type of watercraft is sporting in nature; it turns swiftly, is easily maneuverable, and accelerates quickly. Personal watercraft today commonly carry one rider and one, two or three passengers.

Personal watercraft typically incorporate an engine and associated components within a substantially sealed hull, with one or more air ducts piercing the hull to provide atmospheric air for cooling of the engine and for combustion. While atmospheric air may be sufficient for cooling smaller engines and associated components, as the engines incorporated into personal watercraft become increasingly powerful, cooling requirements for such engines and their associated components significantly increase. To accommodate these increased cooling requirements, therefore, various auxiliary cooling arrangements utilizing fluid from the jet pump unit have been proposed, including cooling of the oil and/or fuel used in the engine, as well as direct cooling of the engine itself. For example, some watercraft auxiliary cooling systems utilize ambient water pumped directly from the pressurization chamber of the installed jet pump unit through a conduit to the engine and/or associated cooled components. Typically attached to a fitting formed on the outer surface of the pressurization chamber, the cooling water conduit passes through the pump chamber, is routed through an opening in the tunnel wall, and travels through the hull interior to the a desired location.

In addition, as labor and production costs for manufacturing personal watercraft increase, manufacturers and consumers alike have become increasingly sensitive to the costs associated with the manufacture of personal watercraft. One time-consuming assembly step, and thus a significant expense in the manufacture of personal watercraft, relates to the installation of the propulsion unit onto the hull of the watercraft. Because the propulsion unit commonly must be adjusted with respect to the longitudinal axis of the watercraft for a proper coupling between the propulsion unit and the engine, propulsion units are often improperly aligned when initially installed on the watercraft hull and must be repositioned during the assembly process. When an alignment discrepancy is found, such units must be re-aligned and re-connected, normally by manufacturing personnel. Moreover, if the propulsion unit was sufficiently misaligned when it was originally installed, the numerous holes cut into the watercraft hull may be inadequate to effect proper mounting of the propulsion unit when in the proper orientation. In such a case, the watercraft hull might require significant repair and/or replacement before the propulsion unit may be properly re-installed.

SUMMARY OF THE INVENTION

The present invention involves in part the recognition that the installation and subsequent repair of misaligned propulsion units in personal watercraft constitutes a significant avoidable cost in the manufacture of personal watercraft.

Thus, a need exists for a mounting arrangement which can quickly, easily and properly orient a propulsion unit before installation on a watercraft. In addition, the present invention involves in part the recognition that a cooling water conduit formed integrally within the wall of the propulsion unit obviates the need for an independent cooling water conduit line within the pump chamber of the watercraft, thus reducing the complexity and number of components located within the pump chamber of the watercraft and simplifying the installation of the propulsion unit.

The present invention discloses a propulsion unit assembly which allows for quick and easy installation of a properly oriented jet pump unit to the hull of the watercraft. The present invention also incorporates a coolant delivery system which provides a pressurized flow of cooling fluid without the presence of a conduit disposed next to the jet pump unit.

Accordingly, one aspect of the present invention involves a personal watercraft comprising a hull having a longitudinal axis. An engine compartment is defined within the hull and an engine is mounted within the engine compartment. A tunnel is defined as an underside of the hull. The tunnel incorporates a front wall having two or more alignment or positioning bosses which cooperate with stoppers on a mounting plate for the propulsion unit of the watercraft. When the alignment bosses are in contact with the stoppers, the mounting plate is properly oriented with respect to the longitudinal axis of the watercraft, and the mounting plate is then attached to the watercraft. When the propulsion unit is later attached to the mounting plate, the proper orientation of the mounting plate ensures that the propulsion unit is properly oriented when installed. It is also understood that the housing for the propulsion unit can additionally or alternatively include similar stoppers that cooperate with bosses formed on the wall(s) of the hull tunnel.

Another aspect of the present invention involves a propulsion unit assembly incorporating an integral cooling fluid delivery system which taps the high-pressure ambient water in the jet propulsion unit, redirecting a small portion of this high-pressure water to the engine and associated engine components for cooling. The integral cooling fluid delivery system includes a series of passages formed within the walls of the pressurization chamber housing, the impeller housing, and the mounting plate. Cooling fluid from the pressurization chamber thus passes through these passages and into the hull interior. Because the disclosed fluid delivery system transfers cooling fluid within the casing of the propulsion unit, there is no need for an independent conduit line for cooling fluid running through the pump chamber of the watercraft, which reduces the number and complexity of components running throughout the pump chamber of the watercraft and simplifies the installation of the propulsion unit.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present watercraft. The illustrated embodiments of the watercraft are intended to illustrate, but not to limit the invention. The drawings contain the following figures.

DETAILED DESCRIPTION OF THE PREFERRED EMBODIMENT

Figure 1:
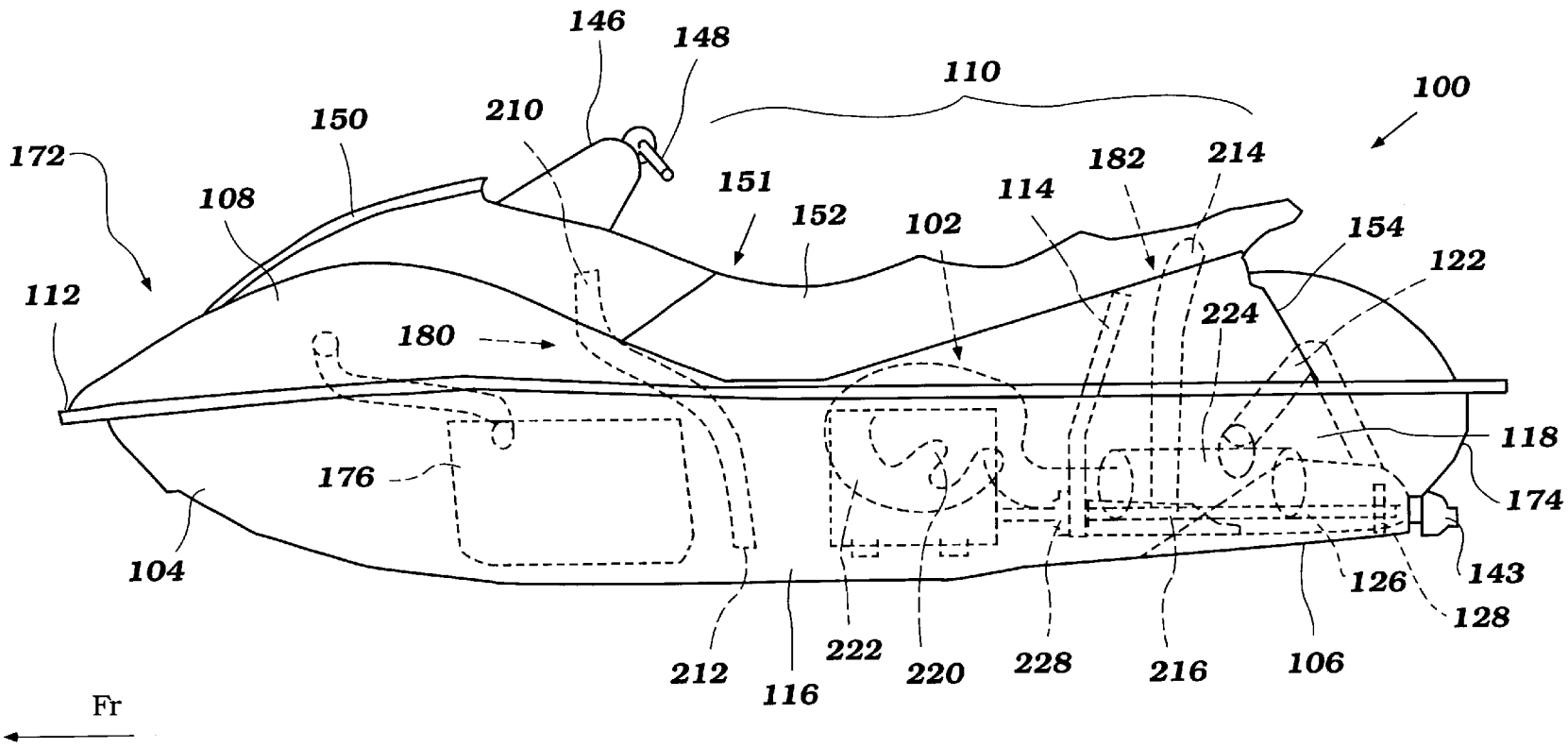
FIG. 1 is a side elevational view of a personal watercraft with a propulsion unit assembly, configured in accordance with a preferred embodiment of the present invention and with various components of the watercraft illustrated in phantom.

With initial reference to FIG. 1, a personal watercraft is indicated generally by the reference numeral 100. The watercraft 100 includes an arrangement of an engine 102 and a propulsion unit assembly configured in accordance with a preferred embodiment of the present invention. Although the present invention is illustrated and described with reference to the illustrated embodiments, it is understood that the propulsion unit assembly can be used with other types of watercraft as well, for example, but without limitation, jet boats and the like.

The following describes the illustrated watercraft in reference to a coordinate system in order to ease the description of the watercraft. A longitudinal axis extends from bow to stem and a transverse axis from port side to starboard side normal to the longitudinal axis. In addition, relative heights are expressed in reference to the undersurface of the watercraft. And in FIGS. 1 and 2, a label "$F_R$" is used to denote the direction the watercraft travels during normal forward operation.

Before describing the propulsion unit assembly in the watercraft 100, an exemplary personal watercraft 100 will first be described in general detail to assist the reader's understanding of the environment of use. The watercraft 100 has a hull, indicated generally by reference numeral 104. The hull 104 can be made of any suitable material; however, a presently preferred construction utilizes molded fiberglass reinforced resin. The hull 104 generally has a lower hull section 106 and an upper deck section 108. A bond flange or gunnel 112 may connect the lower hull section 106 to the upper deck section 108. Of course, any other suitable means may be used to interconnect the lower hull section 106 and the upper deck section 108. Additionally, the lower hull section 106 and the upper deck section 108 may be integrally formed.

As viewed in the direction from the bow to the stem of the watercraft, the upper deck section 108 includes an engine access cover 150, a control mast 146 supporting a handlebar assembly 148 and a rider's area 110. The handlebar 148 controls the steering of the watercraft 100 in a conventional manner. The handlebar assembly also carries a variety of controls of the watercraft 100, such as, for example, a throttle control, a trim control, a start switch and a lanyard switch.

The rider's area 110 lies behind the control mast 146 and includes a seat assembly 151. In the illustrated embodiment, the seat assembly 151 is a longitudinally extending straddle-type seat which may be straddled by an operator and by at least one or two passengers. The seat assembly 151, at least in principal part, is formed by a seat cushion 152 supported by a raised pedestal 154. The raised pedestal 154 forms a portion of the upper deck section 108, and has an elongated shape that extends longitudinally along the center of the watercraft 100. The seat cushion 152 desirably is removably attached to a top surface of the raised pedestal 154 by one or more latching mechanisms (not shown) and covers the entire upper end of the pedestal 154 for rider and passenger comfort.

An engine access opening (not shown) is located in the upper surface of the upper deck section 108. The access opening opens into an engine compartment 116 formed within the hull 104. The engine access cover 150 normally covers and seals closed the engine compartment 116 in a watertight manner. When the engine access cover 150 is removed, the engine compartment 116 of the hull 104 is accessible through the access opening.

The upper deck section 108 of the hull 104 advantageously includes a pair of level planes or foot areas 218 positioned on opposite sides of the aft end of the upper deck section 108. These foot areas 218 extend generally longitudinally and parallel to the sides of the pedestal, and in this position the operator and any passengers sitting on the seat assembly 150 can place their feet on the foot areas 218 during normal operation of the personal watercraft 100. A non-slip (e.g., rubber) mat desirably covers the foot areas 218 to provide increased grip and traction for the operator and passengers.

Figure 2:
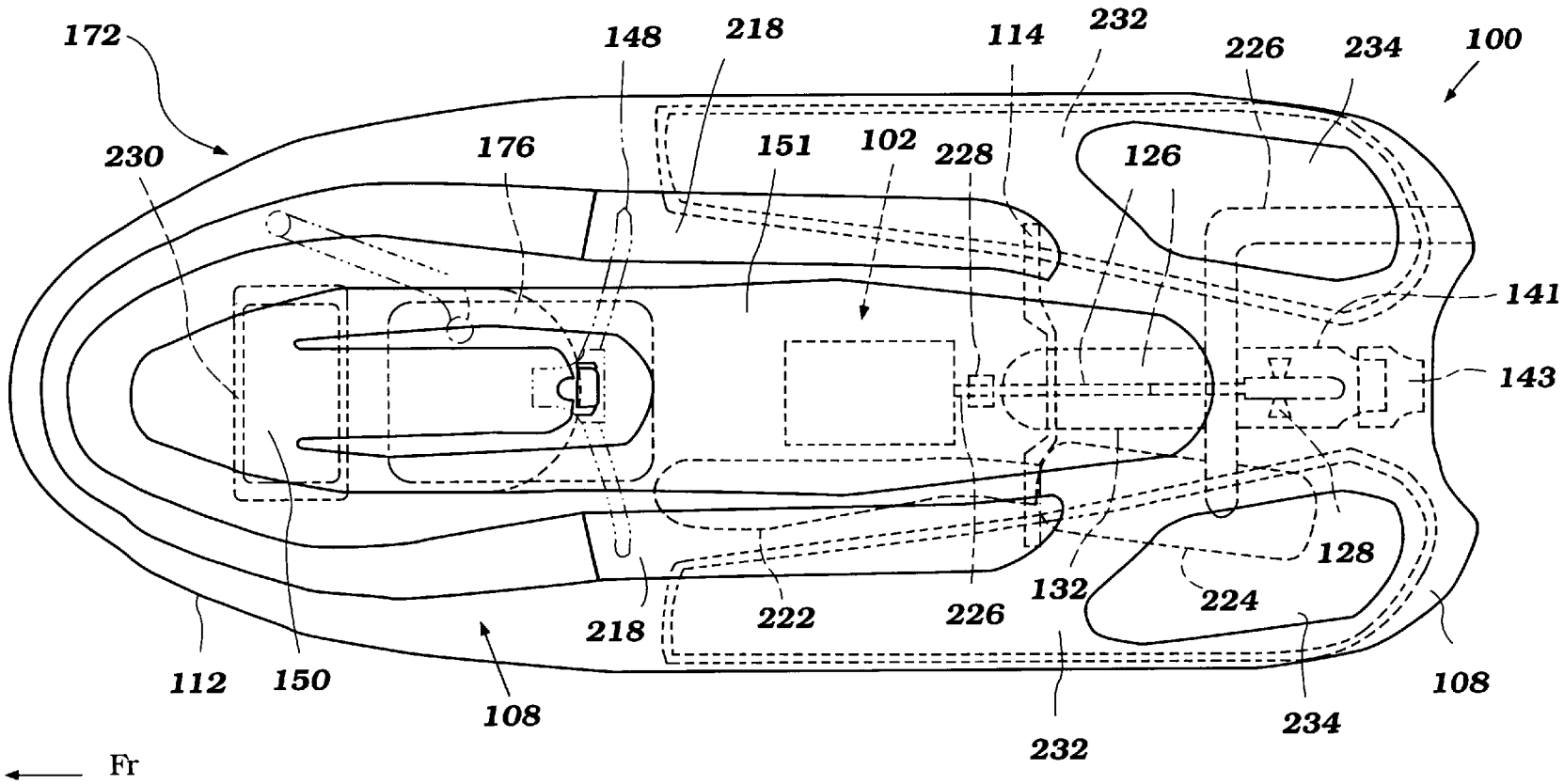
FIG. 2 is a top plan view of the personal watercraft of FIG. 1, with various components of the watercraft illustrated in phantom.

As best seen in FIG. 2, a forward storage compartment 230, formed within the upper deck section 108 of the hull 100, is located forward of the control mast 146. Desirably, this compartment 230 may be accessed through, and is normally sealed closed in a watertight manner by, the engine access cover 150. Similarly, a pair of rear storage compartments 232, formed within the hull 104, are located adjacent the foots areas 218 on each side of the raised pedestal 154. Desirably, these compartments 232 may be accessed through, and are normally sealed closed in a watertight manner by, a pair of rear storage covers 234.

The hull 104 also includes one or more bulkheads 114 which may be used to reinforce the hull internally and which also may serve to define, in part, the engine compartment 116 and the propulsion compartment 118. The engine 102 is mounted within the engine compartment 116 in any suitable manner. For instance, a set of resilient engine mounts (not shown) may be used to connect the engine 102 to a set of stringers (not shown). The engine is desirably mounted in a central transverse position. The engine 102 may be of any known configuration and operates on a variety of principles. For example, the engine 102 may be a two-stroke, four-stroke or rotary type of engine. Additionally, the engine 102 may comprise any number of cylinders. The illustrated engine is a two-stroke engine having two cylinders. The illustrated engine type is merely exemplary.

Forward and rear air intake ducts 180 and 182, in the upper deck section 108 of the watercraft 100, typically allow atmospheric air to enter the engine compartment 116 to be used for combustion and/or cooling. Except for the air ducts, the engine compartment 116 is desirably substantially sealed so as to enclose and isolate the engine 102 and internal components of the watercraft 100 from the body of water in which the watercraft 100 is operated.

The lower hull section 106 is designed such that the watercraft 100 planes or rides on a minimum surface area of the aft end of the lower hull section 106 in order to optimize the speed and handling of the watercraft 100 when up on plane. For this purpose, as is well known in the art, the lower hull section 106 generally has a V-shaped configuration formed by a pair of inclined sections that extend outwardly from a keel line (not shown) to outer chimes (not shown) at a dead rise angle. The inclined sections extend longitudinally from the bow 172 toward the transom 174 of the lower hull section 106 and extend outwardly to side walls (not shown) of the lower hull section 106. The side walls are generally flat and straight near the transom 174 of the lower hull section 106 and smoothly lend towards the longitudinal center of the watercraft 100 at the bow 172. The lines of intersection between the inclined section and the corresponding side wall form the outer chines (not shown) of the lower hull section 106. The lower hull section 106 can also include additional chines between the keel line and the outer chines for improved handling, as known in the art.

Toward the transom of the watercraft 100, the inclined sections of the lower hull section 106 extend outwardly from a recessed channel or tunnel 132 that extends upward towards the upper deck section 108. The tunnel 132 has a generally parallelepiped shape and opens through a transom 174 of the watercraft 100.

A ride plate 304 covers a portion of the tunnel 132 behind the inlet opening 134 to enclose the jet pump unit 126 within the tunnel 132 in a well known manner. Bolts (not shown) desirably secure the ride plate to the lower hull 106. In this manner, the lower opening of the tunnel 132 is closed to provide a planing surface for the watercraft 100. A pump chamber 206 then is defined within the tunnel section covered by the ride plate.

A water grate 300 is positioned over the inlet opening 134 and is secured to the lower hull 106 and the ride plate 304 by bolts 302, 306. Desirably, the water grate 300 comprises a series of laterally spaced ribs which prevent the ingestion of large solid objects capable of damaging the jet pump unit 126 in a manner well known in the art.

An impeller hub 123 and impeller shaft 124 support the rotating impeller 128 within the pump housing assembly 141. Bearings 252 within the impeller hub 123 of the pump housing assembly 141 support and journal the aft end of the impeller shaft 124 in a known manner. The impeller shaft 124 extends in a forward direction through a bulkhead 114. A bearing 228 desirably supports and journals the impeller shaft 124 at a location forward of the bulkhead 114.

The engine 102 powers the impeller shaft 124 about an impeller axis 208. The engine incorporates a crankshaft 226 which is coupled to the impeller shaft 124. The engine 102 is positioned within the engine compartment 116 and is mounted primarily beneath the rider's area 110. The engine is mounted in approximately the centerline of the watercraft 100.

A fuel supply system delivers fuel to the engine 102 in a manner known in the art. The fuel supply system includes a fuel tank 176 located in front of the engine 102. Although not illustrated, at least one pump desirably delivers fuel from the fuel tank 176 to the engine 102 through one or more fuel lines.

The engine 102 typically draws air from the engine compartment 116 through an engine air intake system. Air is supplied to the engine compartment 116 through front and rear air intake ducts 180 and 182. In the disclosed embodiment, atmospheric air travels through a forward air guide port 210, into the forward air intake duct 180, and into the engine compartment 116 through a forward air outlet port 212. In a similar manner, atmospheric air travels through a rear air guide port 214, into the rear air intake duct 182, and into the engine compartment 116 through a rear air outlet port 214.

Although not illustrated, the engine air intake system typically comprises an engine air intake which draws air from the engine compartment 116 and supplies this air to an air intake manifold and carburetor, which supply a fuel/air charge to a plurality of engine cylinders in a known manner. Of course, other arrangements, such as direct or indirect fuel injection, could be used to provide a fuel charge to the engine 102.

The engine exhaust system typically comprises an exhaust manifold 220 which transfers exhaust gases exiting the combustion chambers (not shown) of the engine 102 to an engine exhaust pipe 222. The exhaust manifold 220 thus generally comprises a merge chamber and a plurality of exhaust runner passages as known in the art. The engine exhaust pipe 222 transfers exhaust gases to a watertrap 224. The watertrap 224 is a well known device that allows the passage of exhaust gases, but contains baffles which prevent water from passing back through the engine exhaust pipe into the engine 102. In the present embodiment, the watertrap is located behind the engine 102. The watertrap 224 transfers exhaust gases to a watercraft exhaust pipe 226. The watercraft exhaust pipe 226 discharges the exhaust gases to the pump chamber 206 and the atmosphere. Desirably, at least one section of the watercraft exhaust pipe 226 is positioned higher than the watertrap 224 and the pump chamber 206, such that the passage of water through the watercraft exhaust pipe 226 into the watertrap 224 is inhibited.

As previously noted, the exemplary engine 102 is an internal combustion engine of a known stroke variety. Because the engine is conventional, the internal details of the engine are not believed necessary for an understanding of the present speed monitoring system. In addition, while the present invention is illustrated and described with reference to a propulsive device comprising a jet pump unit, various other types of propulsive devices may also be used with the present invention.

In the illustrated embodiment, a jet pump unit 126 of the propulsion unit assembly propels the watercraft 100. The jet pump unit 126 is mounted within the tunnel 132, formed on the underside of the lower hull section 106, by a plurality of bolts (not shown). An inlet opening 134 formed in the bottom of the hull 104 opens into a gullet 138 which leads through a duct 136 to a pump housing assembly 141 of the jet pump unit 126.

A steering nozzle 143 is supported at the downstream end of the discharge nozzle 142 by a pair of vertically extending pivot bolts 144 which rotatably secure the discharge nozzle 142 to a support ring 188. In the exemplary embodiment, the steering nozzle 143 has an integral lever 184 on one side that is coupled to the handlebar assembly 148 through, for example, a bowden-wire actuator 186, as known in the art. Desirably, the bowden wire extends through an opening 308 in the hull 104 and mounting plate 236. Desirably, this opening 308 is sealed in a substantially watertight manner by a seal 312 as is well known in the art. In this manner, the operator of the watercraft 100 can move the steering nozzle 143 about an essentially vertical rotational axis to effect directional changes of the watercraft 100. The support ring 188 is rotatably secured to the discharge nozzle 142 by a pair of support pins 190, which allow the support ring 188 to rotate about an essentially horizontal axis. In an exemplary embodiment, a trim lever 192 is attached to the support ring 188 that is coupled to the handlebar assembly 148 through a trim cable 194. Desirably, the trim cable 194 (shown partially) extends through an opening 310 in the hull 104 and mounting plate 236. This opening 310 is desirably sealed in a substantially watertight manner by a seal 314 as is well known in the art. In this manner, the operator of the watercraft 100 can adjust the trim angle of the steering nozzle 143.

A pair of brackets 198 are secured to the jet pump unit 126 by bolts 200 or other fasteners well known in the art. A reverse bucket 196 is rotatably secured to the brackets 198 by support pins 202. In the disclosed embodiment, the reverse bucket 196 is coupled to the handlebar assembly 148 through a reverse cable (not shown), as known in the art. In this manner, the operator of the watercraft 100 is able to selectively orient the reverse bucket relative to the flowpath of water flowing out of the nozzles 142, 143. When the reverse bucket is within the flowpath of water out of the nozzles 142, 143, the bucket 196 redirects the flow of water, which induces a reverse thrust on the watercraft in a manner well known in the art. Conversely, if the reverse bucket is out of the flowpath of the water flowing out of the nozzles 142, 143, the flow of water through the nozzles 142, 143 will impel the watercraft 100 forward in its normal manner.

Figure 4:
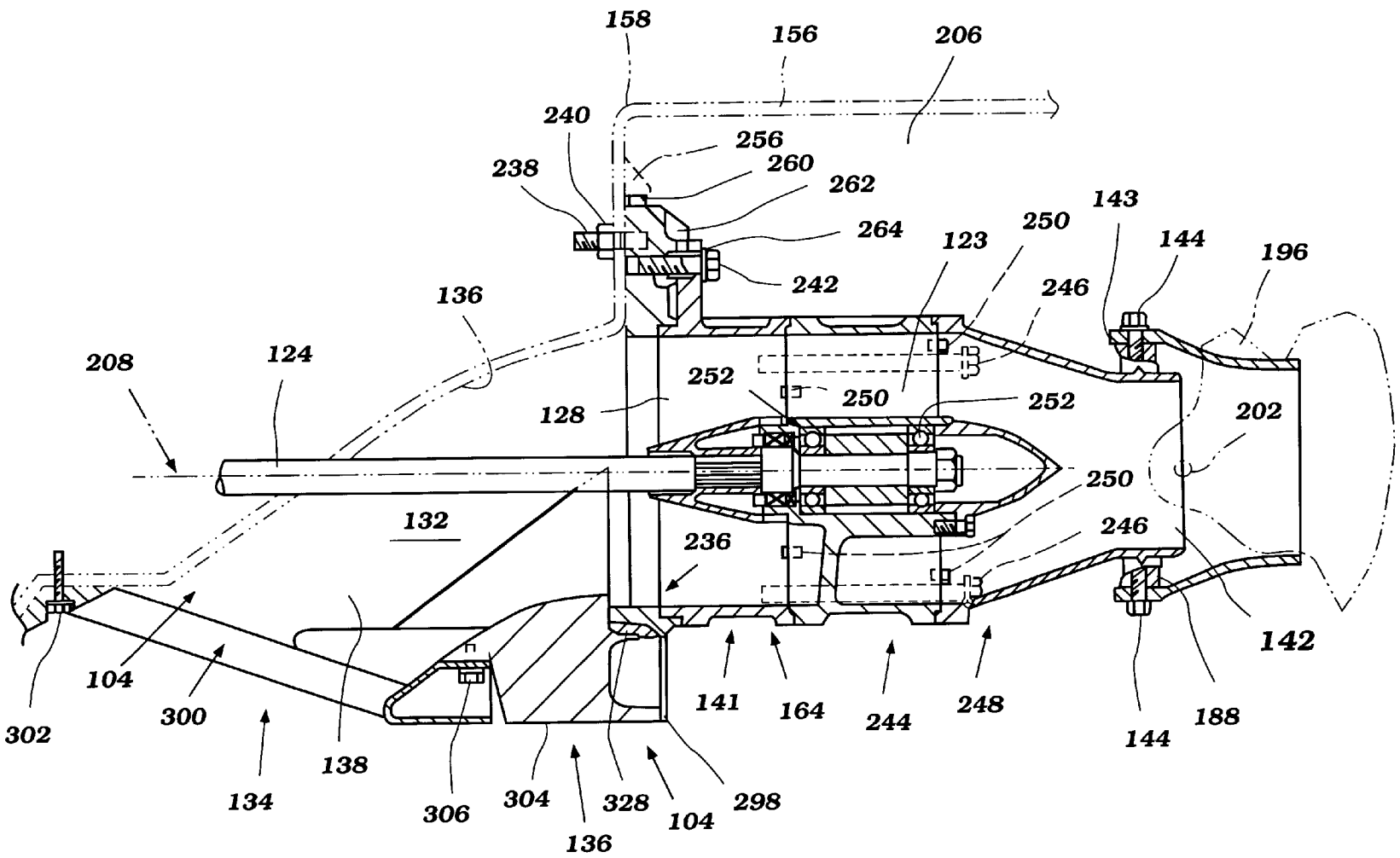
FIG. 4 is a partial sectional side view of the propulsion unit assembly taken along line 4—4 of FIG. 3.

In the embodiment disclosed, the pump housing assembly 141 is comprised of an impeller housing 164, a pressurization chamber housing 244 and a discharge nozzle section 248. As best seen in FIG. 4, these sections 164, 244, 248 nest together, and are held together by a plurality of bolts 246. A plurality of positioning pins 250 extend between the sections 164, 244, 248 to ensure that the pump housing assembly is properly assembled and to prevent rotation of the individual sections with respect to each other.

Figure 3:
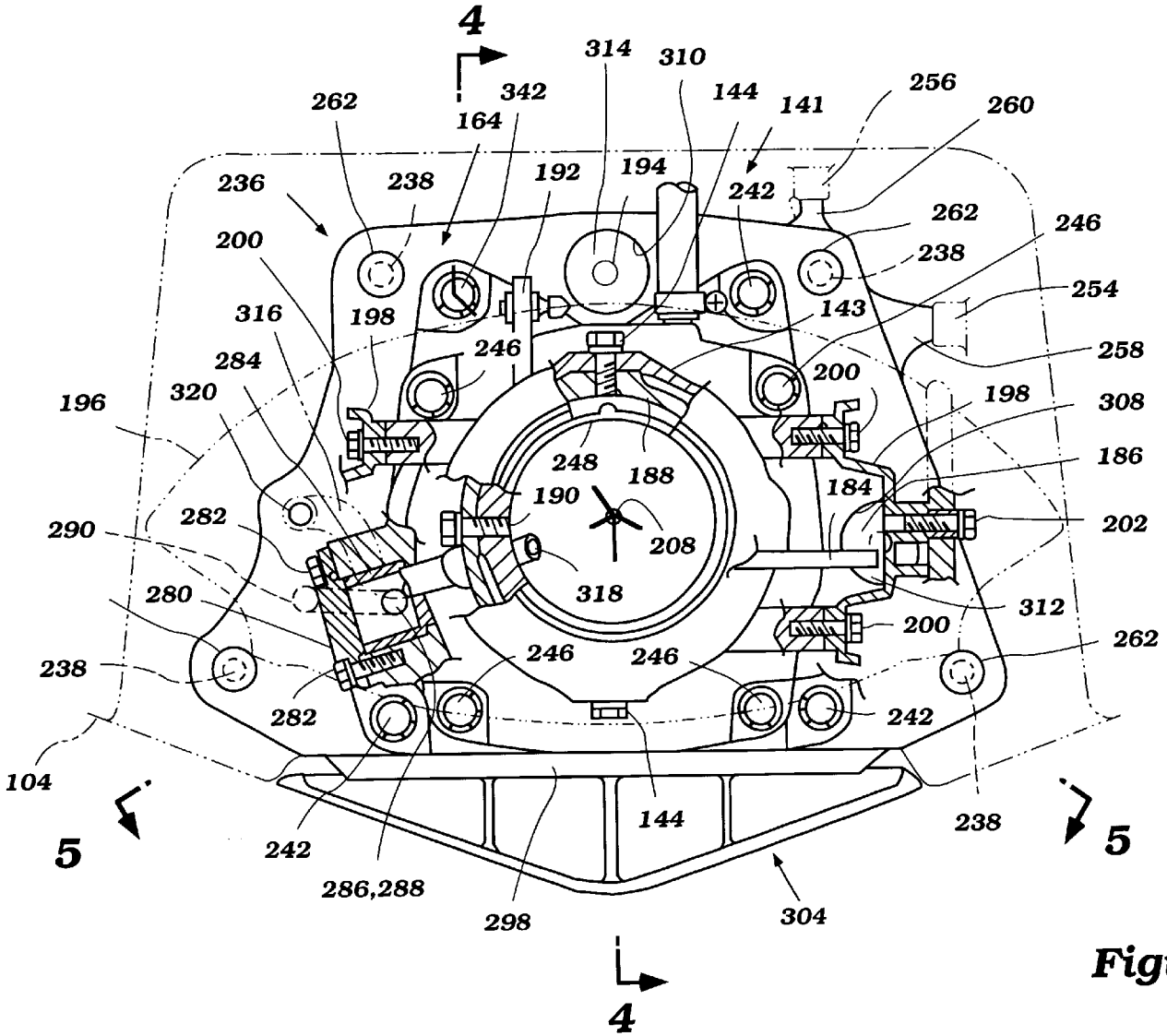
FIG. 3 is a partial sectional rear plan view of the propulsion unit assembly of FIG. 1, with various components of the watercraft illustrated in phantom.
Figure 3A:
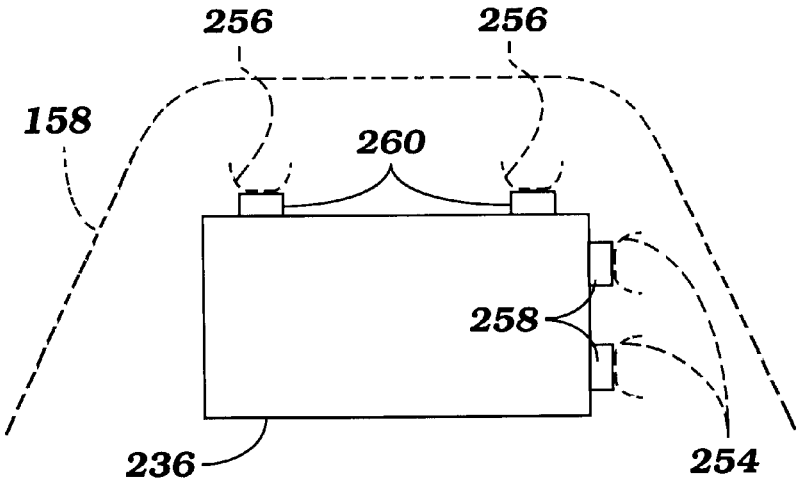
FIG. 3*a* is a partial schematic illustration of a rear plan view of a modification of the propulsion unit assembly shown in FIG. 3.
Figure 3B:
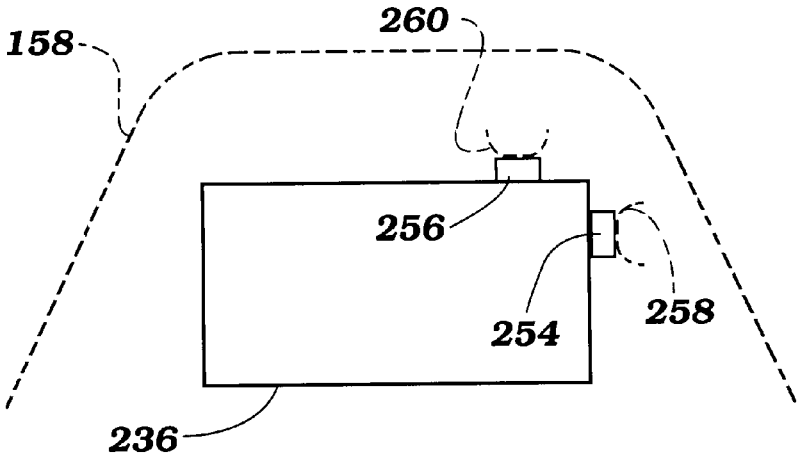
FIG. 3*b* is a partial schematic illustration of a rear plan view of a further modification of the propulsion unit assembly shown in FIG. 3.

As best seen in FIGS. 3 and 4, the tunnel 132 in general is formed by a ceiling 156, sidewalls (not shown) and a front wall 158. A mounting plate 236 is secured to the front wall 158 by bolts 238 and nuts 240, or other fastening means well known in the art. The bolts 238 extend outward from mounting bosses 262 formed in the mounting plate 236. Similarly, the impeller housing 164 of the pump housing assembly 141 is secured to the mounting plate 236 by bolts 242 or other fastening means well known in the art. In the disclosed embodiment, a positioning pin 264, extending between the mounting plate 236 and the impeller housing 164, inhibits rotation and/or movement of the impeller housing 164 relative to the mounting plate 236.

A bilge hose 342, in fluid communication with the interior of the hull 104 of the watercraft 100, is in fluid communication with a first bilge drain pipe 340. The first bilge drain pipe 340 extends through the front wall 158 of the hull 104, and into an opening formed in the mounting plate 236. A bilge drain pipe 320, in fluid communication with the first bilge drain pipe 340, extends outward from the mounting plate 236 and connects to a bilge drain hose 316. The bilge drain hose 316 extends rearward from the bilge drain pipe 320, with an end part (not shown) of the hose 316 extending through and into the pump housing assembly 141. Desirably, the end part of the hose 316 is oriented away from the water flowing through the discharge nozzle section 248, such that the flow of high-pressure water through the nozzle 142, past the end part, produces a venturi-effect vacuum, drawing water and/or air out of the bilge, through the bilge drain hose 316 and into the pump housing assembly 141 where this water and/or air is expelled through the discharge nozzle 142 of the watercraft 100. If desired, a second bilge drain pipe 322, which extends through the front plate 158 and the mounting plate, may be used in a similar manner to drain water from the interior of the hull 104 of the watercraft 100, or may be used in conjunction with a bilge pump (not shown) located within the hull 104 of the watercraft 100.

In the disclosed embodiment, a horizontal positioning boss 254 and a vertical positioning boss 256 are formed on the front wall 158 of the tunnel 132. These bosses are located such that, when the bosses 254, 256 are in contact with a vertical stopper 260 and a horizontal stopper 262 formed on the mounting plate 236, the mounting plate (and subsequently the jet pump unit) will be properly oriented relative to the longitudinal axis of the watercraft. In such a case, the mounting plate can easily be mounted directly to the hull 104 of the watercraft 100 in a quick and easy manner.

As best seen in FIG. 3, the positioning bosses 254, 256 are desirably cup-shaped receptacles which accept the protruding ends of the stoppers 258, 260. However, it should be understood that other types of positioning bosses and stoppers could be used to accomplish the objective of physically marking the desired location for the mounting plate. For example, the positioning bosses could incorporate ends which insert into receptacles formed in the stoppers, or the bosses and stoppers could merely have common surfaces which lie against one another when the mounting plate is in its proper orientation. Alternatively, the bosses could comprise protrusions which directly contact the mounting plate.

Desirably, the bosses are orthogonally oriented such that the bosses define a desired position for the mounting plate 236 along a two-dimensional plane. For example, as best seen in FIG. 3, the horizontal positioning boss 254 defines a desired horizontal position of the mounting plate 236 when the boss 254 contacts the horizontal stopper 258. Similarly, the vertical positioning boss 256 defines a desired vertical position of the mounting plate when the boss 256 contacts the vertical stopper 260. In this manner, the two bosses 254, 256 define a desired location for the mounting plate 236 along the front wall 158 of the tunnel 132.

Although the bosses disclosed are oriented at approximately 90 degrees from each other, and each boss defines either a desired horizontal or desired vertical position for the mounting plate, it should be understood that other orientations and/or alternate positions for the bosses could accomplish the goal of defining a desired two-dimensional position and/or orientation for the mounting plate. For example, the bosses could be oriented at angles other than 90 degrees apart, or could be positioned along various walls of the tunnel. In addition, if desired, the bosses could be positioned such that the desired vertical or horizontal positioning of the mounting plate is be defined by more than one boss, such as, for example, where the desired horizontal position of the mounting plate is defined by a plurality of bosses that also define the desired vertical position of the plate. In such a case, the horizontal positioning boss would define the position of the mounting plate along a line which is oriented between 0 degrees and 45 degrees relative to the transverse axis of the watercraft.

Desirably, the location and sizes of the bosses and stoppers will be pre-determined during the initial stages of the manufacturing process, such that the installation of the mounting plate (and subsequently the jet pump unit) can proceed quickly and easily. However, it is also possible to alter the location and/or size of the bosses and/or stoppers at virtually any point prior to installation of the mounting plates, and where unique manufacturing conditions and/or variations in components exists, such flexibility can facilitate quick and easy installation and assembly of the watercraft.

During installation of the mounting plate 256 onto the front wall 158, the cylindrical portion 170 of the mounting plate 256 is inserted into the opening in the front wall 158 of the tunnel 132, with the bolts 238 on the mounting plate 236 inserted through pre-drilled openings (not shown) in the front wall 158. Because these pre-drilled openings are typically larger in diameter than the bolts 238, the mounting plate 236 is desirably able to move and/or rotate a small amount with respect to the front wall 158. In order to properly orient the mounting plate 236 with respect to the front wall 158, the mounting plate 236 is moved and/or rotated such that the vertical stopper 260 contacts the vertical positioning boss 256, and the horizontal stopper 258 contacts the horizontal positioning boss 254. The nuts 240 on the bolts 238 are then tightened, securing the mounting plate 256 into its proper position against the front wall 158 of the tunnel 132. In this position, a flange 298 extending downward from the mounting plate 236 desirably abuts against the ride plate 304 in a known manner.

To reduce and/or eliminate passing between the mounting plate 236 and the front wall 158 of the tunnel 132, as well as between various other components, watertight packing or gaskets 266, 268, 270 and seals 328 are provided. These gaskets 266, 268, 270 and seals 328, which are comprised of various materials such as rubber, silicone, cork, or other sealing compositions well known in the art, are compressed between various components to desirably limit and or prevent water from leaking out of the jet propulsion unit and/or into the hull 104 of the watercraft 100.

After the mounting plate 236 is properly mounted to the hull 104 of the watercraft, the pump housing assembly 141 may be secured to the mounting plate 236 by bolts 242 or other fastening means well known in the art. In this manner, the jet propulsion unit is quickly and easily properly oriented and secured to the hull 104 of the watercraft 100 using minimal time and effort.

Figure 5:
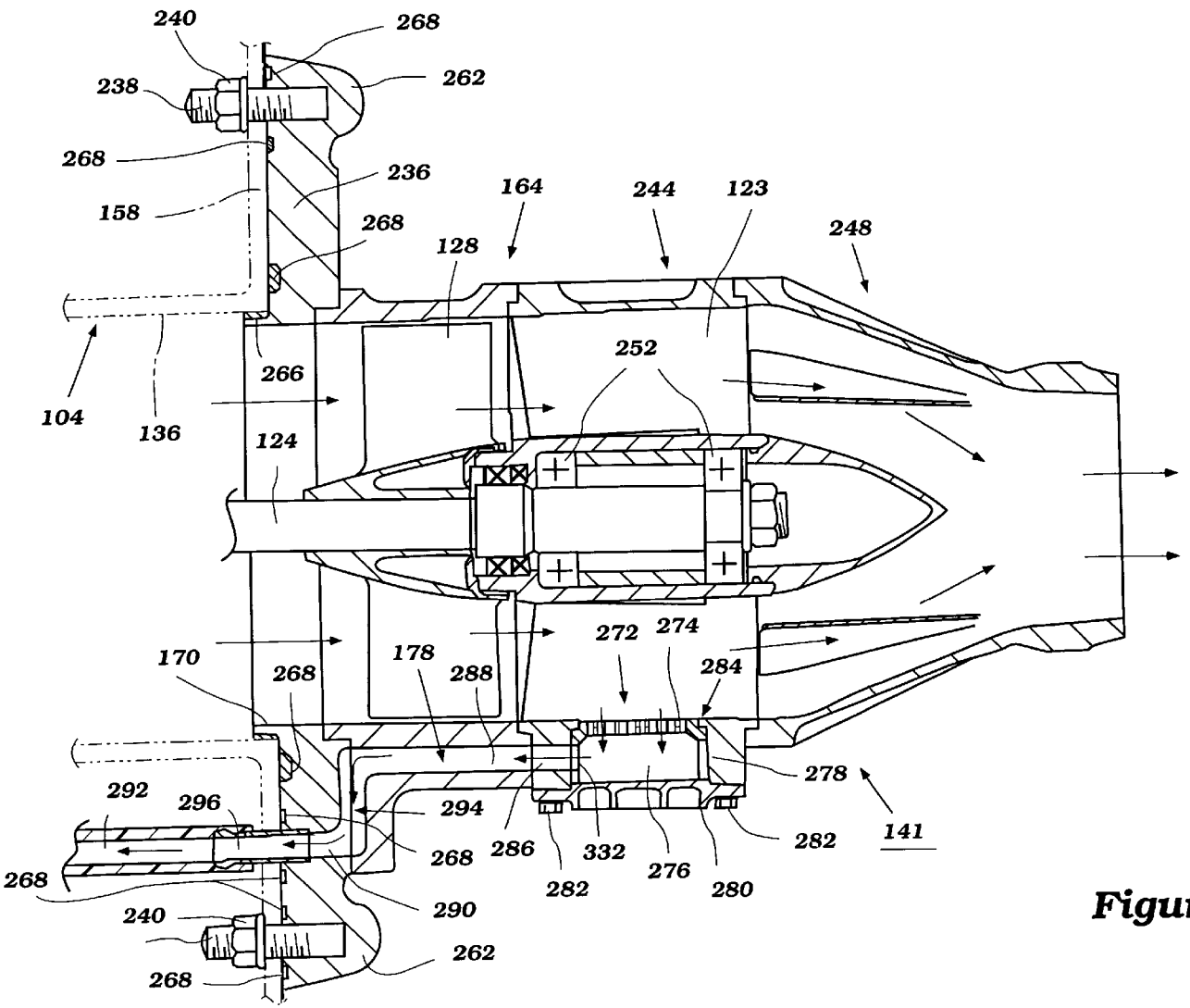
FIG. 5 is an enlarged sectional side view of the propulsion unit assembly taken along line 5—5 of FIG. 3.

As can best be seen from FIGS. 3 and 5, the disclosed embodiment of a propulsion unit assembly further includes a cooling water conduit which provides pressurized cooling water for the engine 102 and/or assorted components of the watercraft 100. The cooling water conduit includes a coolant inlet housing 272 formed in a wall of the pressurization chamber housing 244. The coolant inlet housing 272 comprises an opening formed in the wall of the pressurization chamber 244 and elevated walls 278 which extend outward from the pressurization chamber housing 244. A closure plate 280, which is secured to the outer ends of the elevated walls 278 by bolts 282 or other fastening means well known in the art, desirably seals the coolant inlet housing 272 closed in a watertight manner.

Figures 11A, 11B, 11C:
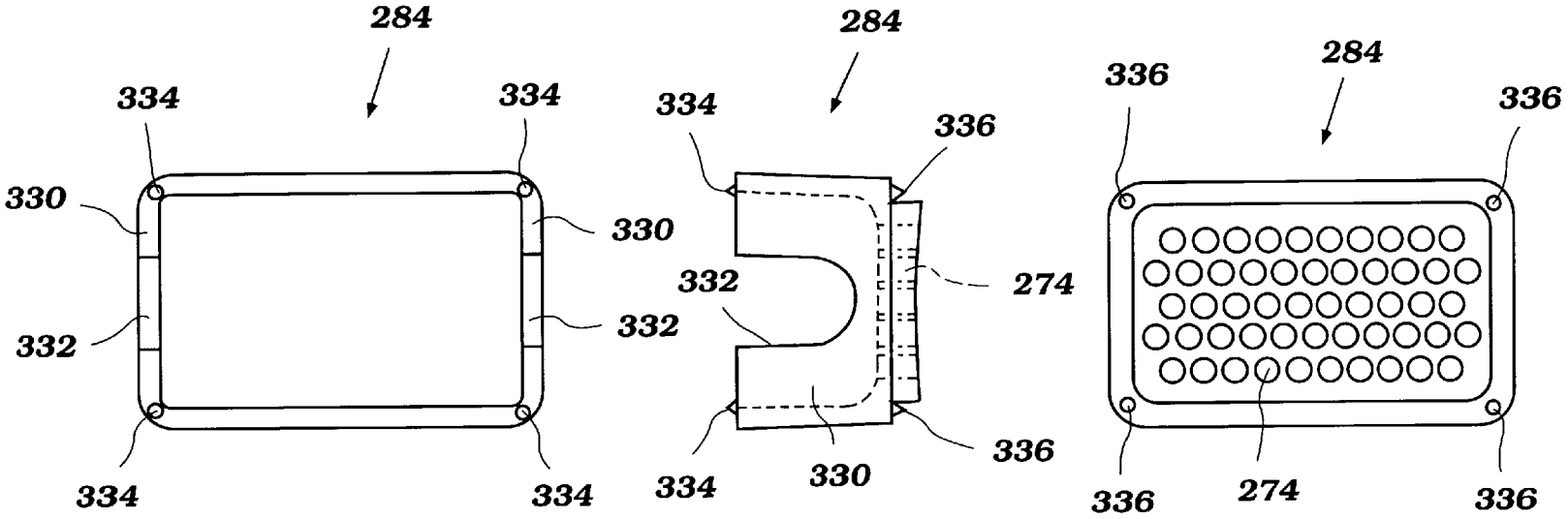
FIG. 11A is a side view of a filter element of a cooling water delivery system which is configured in accordance with a preferred embodiment and is integrated into the propulsion unit assembly of FIG. 3.
FIG. 11B is a bottom plan view of the filter element of FIG. 11A.
FIG. 11C is a top plan view of the filter element of FIG. 11A.

Desirably, a filter housing 284 is secured within the coolant inlet housing 272 during operation of the watercraft. As best seen in FIGS. 11A, 11B and 11C, the filter housing 284 desirably comprises a filter element having a plurality of openings 274 through which cooling liquid can flow. A plurality of side walls 330 is formed around the filter element, with cutaway portions 332 of the side walls 330 being formed in opposing ends of the side walls 330. Projections 334, 336, formed on the upper and bottom surfaces of the filter 284 housing, desirably secure the filter housing 284 in position within the coolant inlet housing 272 during watercraft operation.

As best seen in FIG. 5, a coolant passage 178 is provided that channels cooling fluid from the coolant inlet housing 272 to a coolant hose 292 leading to the engine 102 of the watercraft 100. The coolant passage 178 comprises a pressurization chamber passage 286, an impeller housing passage 288 and a mounting plate passage 290. The pressurization chamber passage 286, formed within an elevated wall 278 of the pressurization chamber housing 244, is in fluid communication with the coolant inlet housing 272 through an opening formed in one elevated wall 278 of the coolant inlet housing 272. The pressurization chamber passage 286 is also in fluid communication with the impeller housing passage 288, which is formed in a wall of the impeller housing 164. A grooved coolant passage 294, formed by cooperating grooves formed in the walls of the mounting plate 236 and the impeller housing 164, is in fluid communication with the impeller housing passage 288 and a mounting plate passage 290 formed in the mounting plate 236.

A coolant inlet pipe 296 extends through an opening formed in the hull 104 of the watercraft 100. The coolant inlet pipe 296 is connected to, and in fluid communication with, the mounting plate passage 290 and the coolant hose 292. A gasket 268 desirably seals the opening around the coolant inlet pipe 296 in a watertight manner as well known in the art. Drain pipes 322, 338, formed in the mounting plate 236, extend through the front wall 158 of the hull 104, and facilitate discharge of water from the interior of the hull 104 of the watercraft 100.

During normal operation of the watercraft 100, the rotating impeller 128 will impart significant kinetic energy to the water drawn into the jet pump unit 126, significantly increasing the velocity and pressure of the water within the pump housing assembly 141. The high pressure/velocity will induce some of the water to travel through the openings 274 in the filter and into the coolant inlet housing 272. Subsequently, this water will travel through one of the cutaway portions 332, through the coolant passage 178, through the coolant hose 292, and ultimately be transferred to the engine 102 and/or the associated components.

Because the high-pressure cooling water from the pump housing assembly 141 travels through the passages formed integrally within the walls of the pump housing assembly 141, the present invention obviates the need for a conduit which extends from the pressurization chamber into the pump chamber. Thus, the complexity and number of components within the pump chamber are reduced. In addition, because the cooling water conduit is already substantially assembled before the propulsion unit is attached to the watercraft hull, assembly of the watercraft 100 is simplified.

Figure 6:
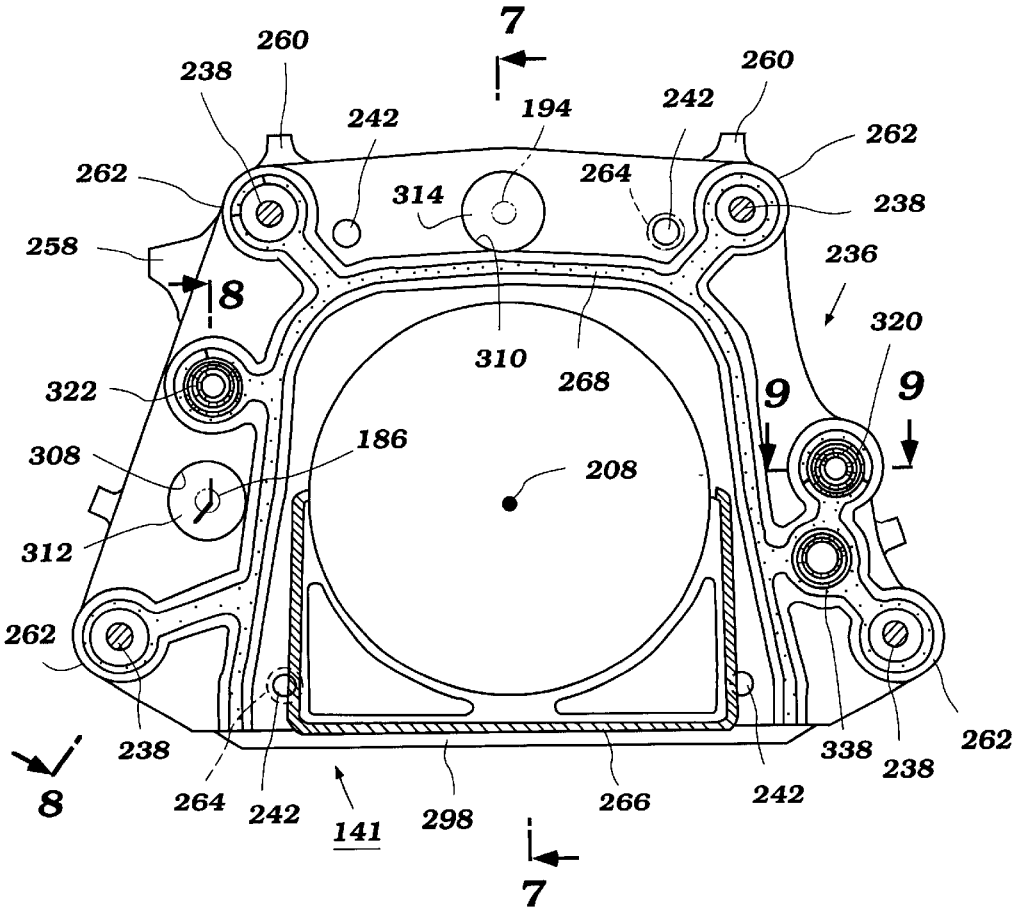
FIG. 6 is a front view of an alternate embodiment of a mounting plate.
Figure 7:
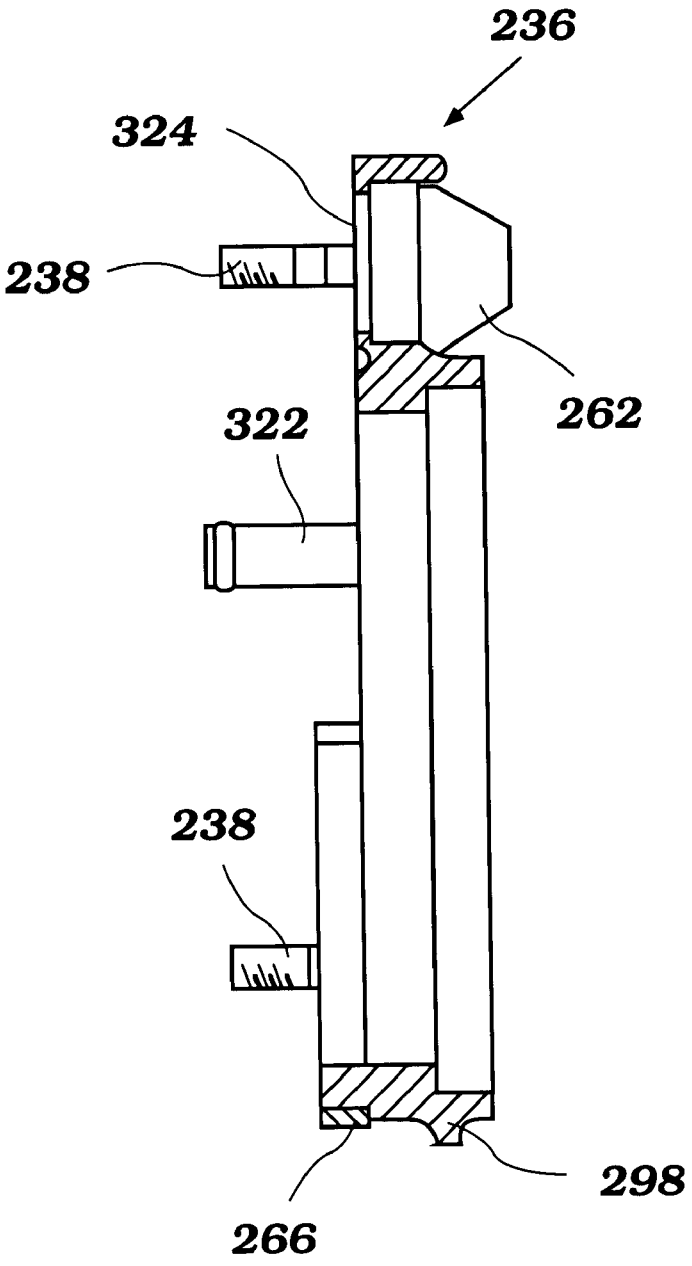
FIG. 7 is a cross-sectional view of the mounting plate taken along line 7—7 of FIG. 6.
Figure 8:
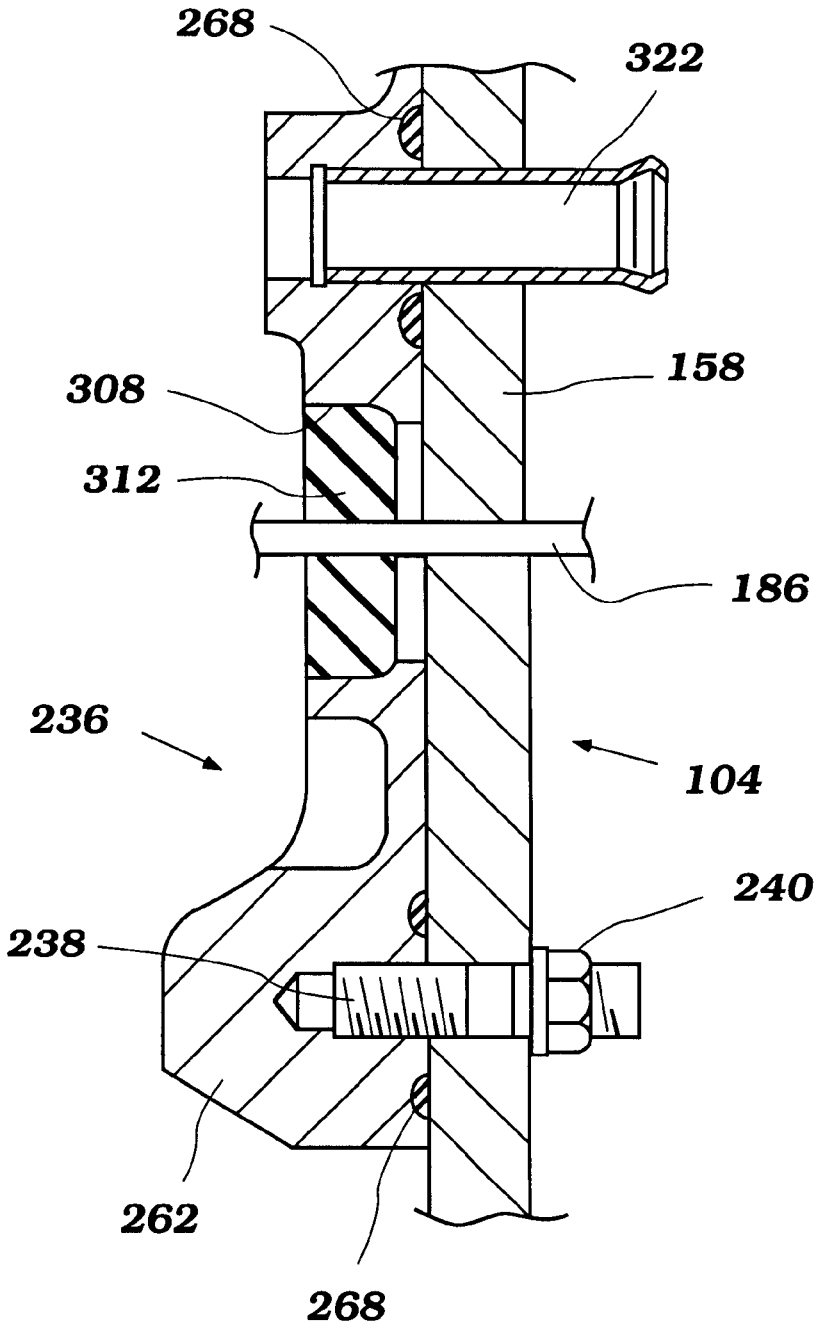
FIG. 8 is a partial cross-sectional view of the mounting plate taken along line 8—8 of FIG. 6.
Figure 9:
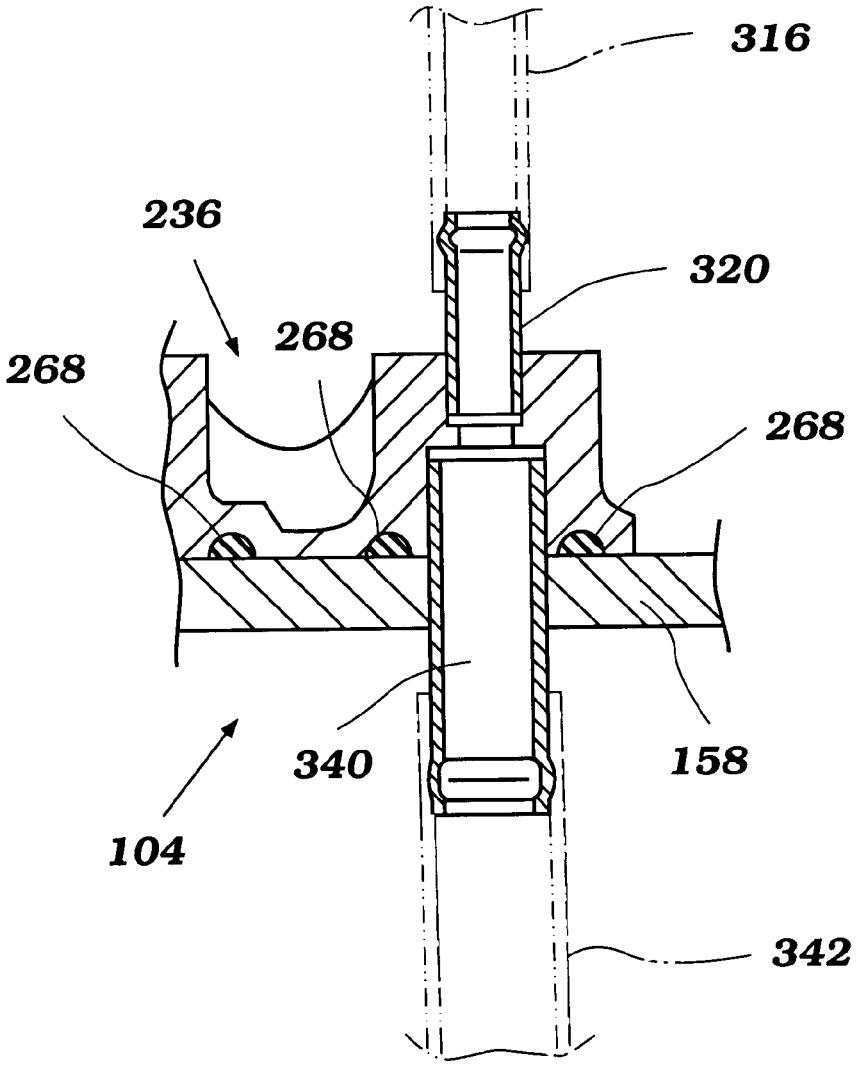
FIG. 9 is a partial cross-sectional view of the mounting plate taken along line 9—9 of FIG. 6.
Figure 10:
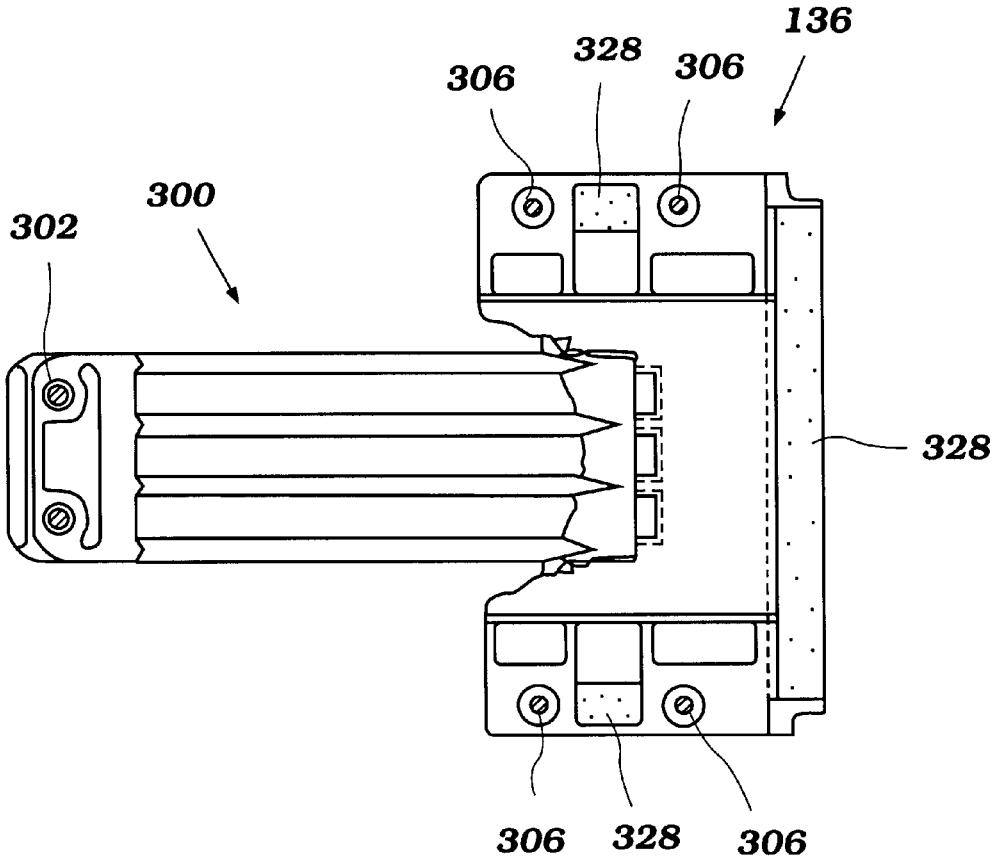
FIG. 10 is a partial bottom plan view of the mounting plate and a water guide of the propulsion unit assembly of FIG. 3, shown as isolated from the balance of the assembly.

FIG. 6 illustrates another embodiment of a propulsion unit assembly for a personal watercraft 100 in accordance with another preferred embodiment of the present invention. The principal differences between the present embodiment and the embodiment of FIGS. 1–5 lie with the configuration of the tunnel mounting plate. Therefore, for ease of description, similar features are ascribed the same reference numerals used for corresponding elements from the embodiments of FIGS. 1–5. Unless otherwise indicated, the above description of similar components should be understood as applying equally to the following embodiment.

FIG. 6 illustrates a mounting plate incorporating a plurality of vertical stoppers 260 and a single horizontal stopper 258. This embodiment can be especially useful where a variety of watercraft designs are being manufactured in the same facility. In order to ensure that mounting plates from differing watercraft design are not confused and installed accidentally (virtually certain to result in misalignment of the jet pump units), the incorporation of multiple stoppers and/or bosses allows each mounting plate to be "custom-designed" to fit only a single model of watercraft. A mounting plate with incorrect stoppers, or with stoppers which do not fit over the corresponding bosses, clearly indicates that the mounting plate should not be installed on the watercraft. In this manner, the accidental use of an incorrect size or shape mounting plate can be prevented before any holes are drilled in the watercraft hull.

While not illustrated, a corresponding front wall of a watercraft for use with the embodiment of a mounting plate disclosed in FIG. 6 would desirably incorporate a plurality of vertical positioning bosses and a single horizontal positioning boss. Of course, such a plate could possibly be used with a front wall having only a single pair of vertical and horizontal positioning bosses, as well.

Figure 12:
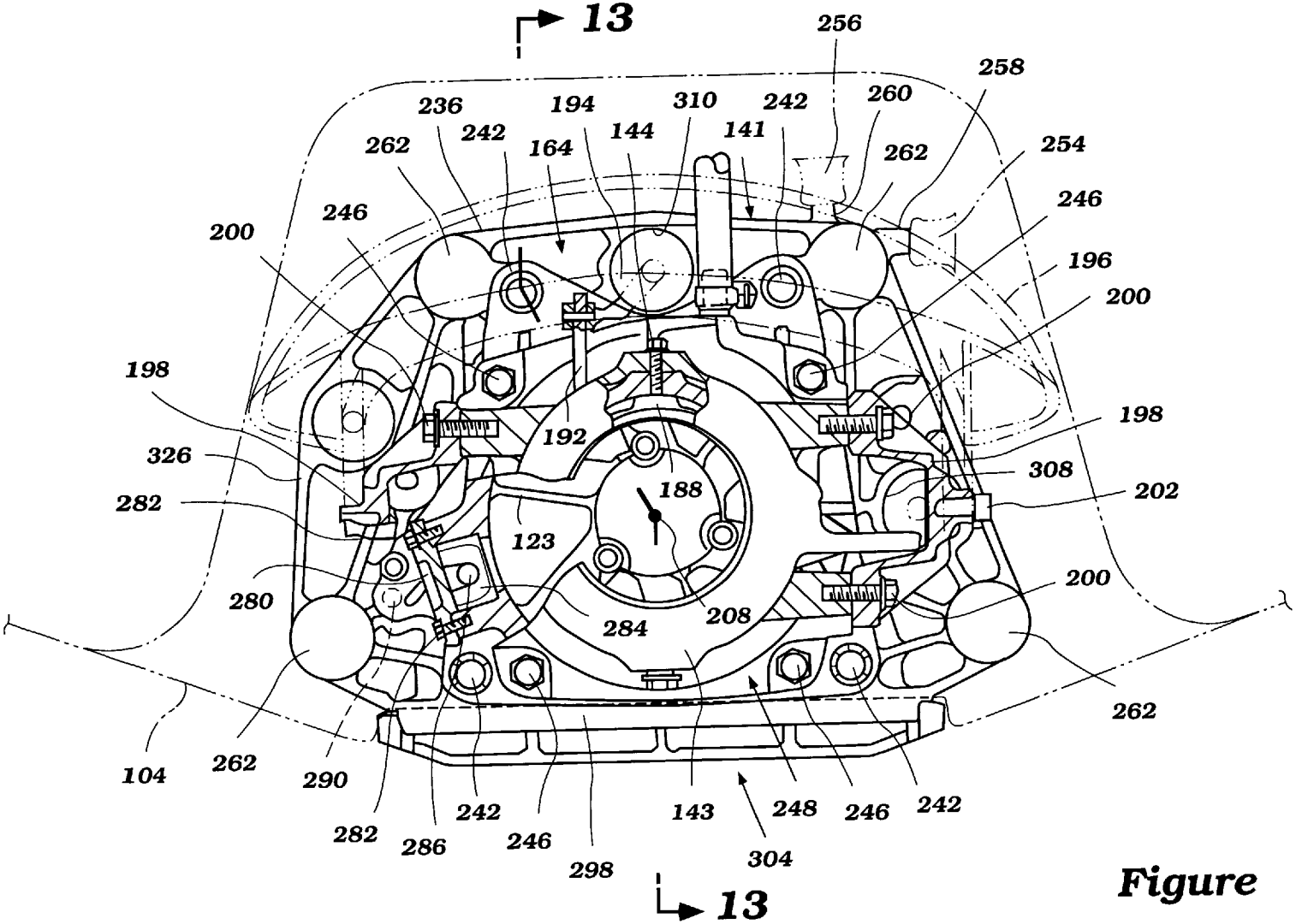
FIG. 12 is a partial sectional rear view of a propulsion unit assembly for a personal watercraft constructed in accordance with another embodiment of the present invention, with various components of the watercraft illustrated in phantom.
Figure 13:
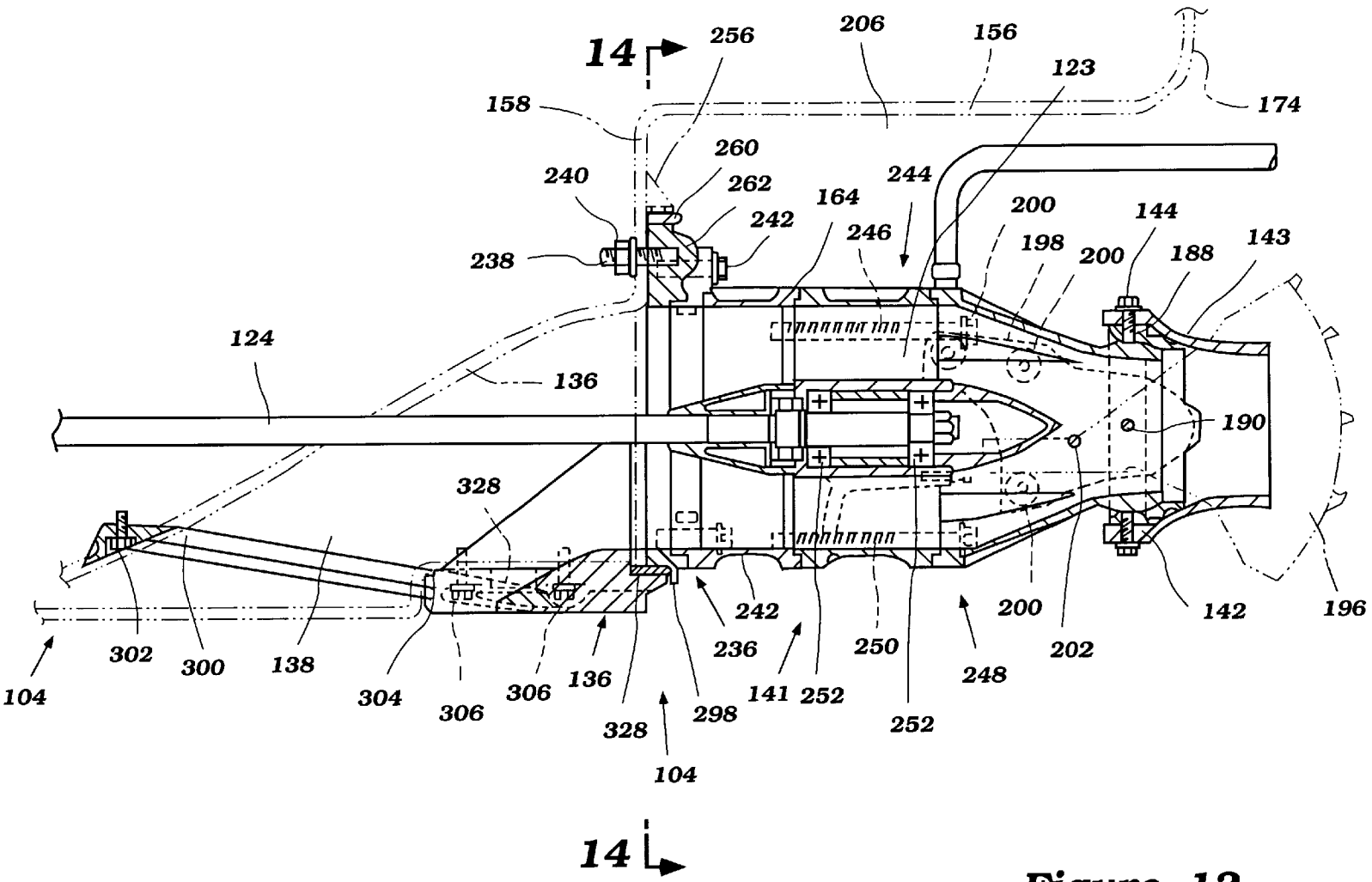
FIG. 13 is a partial sectional side view of the propulsion unit assembly taken along line 13—13 of FIG. 12.
Figure 14:
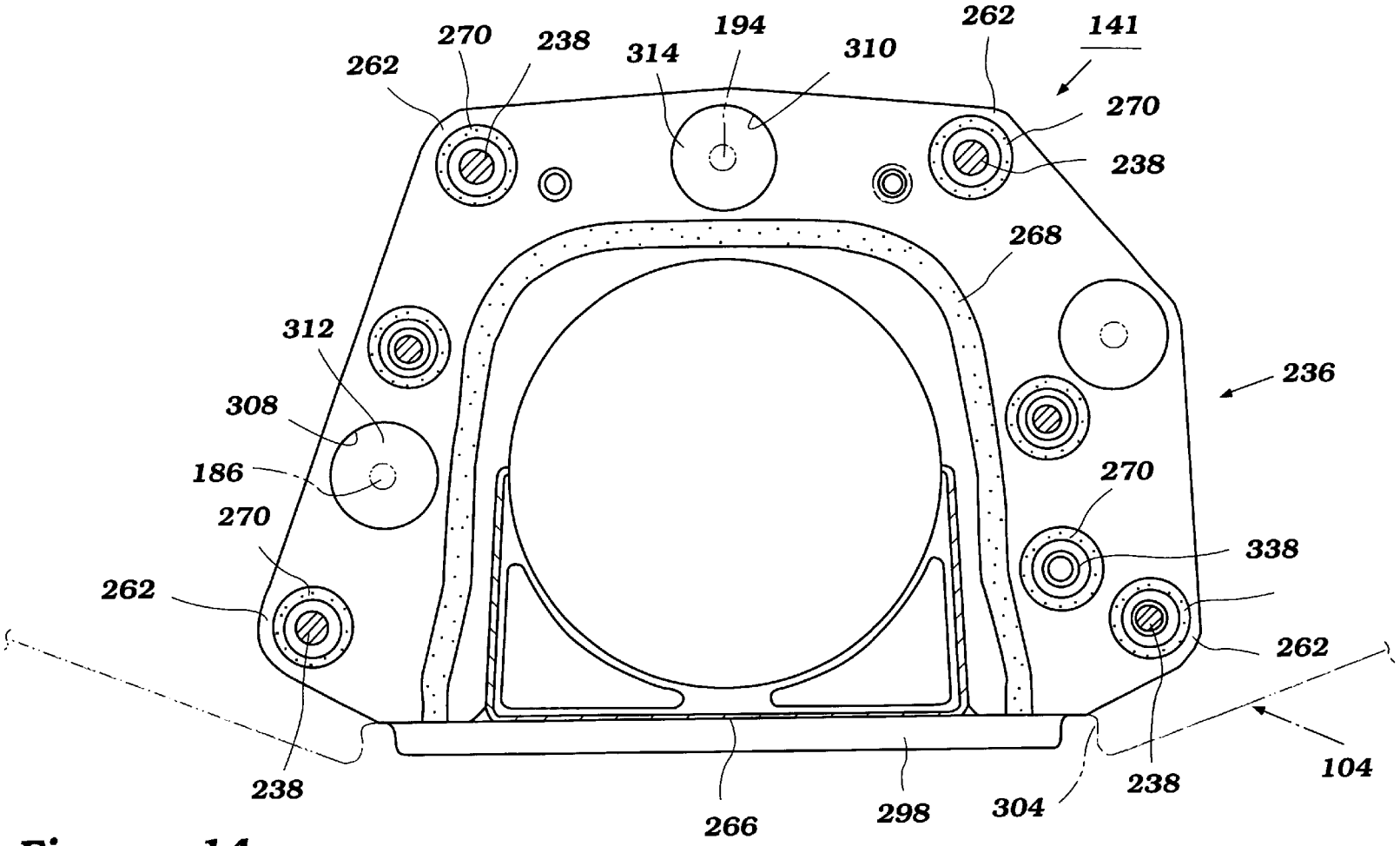
FIG. 14 is a sectional view of the propulsion unit assembly taken along line 14—14 of FIG. 13, and illustrates a mounting plate of the assembly.

FIG. 12 illustrates an alternate embodiment of a propulsion unit assembly for a personal watercraft 100 in accordance with another preferred embodiment of the present invention. The principal differences between the present embodiment and the embodiment of FIGS. 1–5 lie with the configuration of the front wall of the tunnel and the mounting plate. Therefore, for ease of description, similar features are ascribed the same reference numerals used for corresponding elements from the embodiments of FIGS. 1–5. Unless otherwise indicated, the above description of similar components should be understood as applying equally to the following embodiment.

Similar to the embodiment of FIGS. 1–5, the present embodiment discloses a mounting plate 236 incorporating horizontal and vertical stoppers 258, 260 and positioning bosses 254, 256 to properly orient the mounting plate 236 against the front wall 158 prior to installation. In this embodiment, however, the mounting plate comprises a plurality of reinforcing stiffening ribs 326 which are formed on the outside of the plate 236 on the side away from the front wall 158 of the hull 104. This arrangement provides for proper orientation and support of the pump housing assembly 141, but allows the thickness of the mounting plate to be reduced without significantly affecting the strength of this plate 236. Desirably, this significantly reduces the weight of the mounting plate 236. Thus the present embodiment incorporates all the previously disclosed advantages, with the added benefit of reducing the weight of the personal watercraft.

Although this invention has been described in terms of certain embodiments, other embodiments apparent to those of ordinary skill in the art also are within the scope of this invention. Thus, various changes and modifications may be made without departing from the spirit and scope of the invention. For example, various combinations of the preferred embodiments are possible. Accordingly, the scope of the invention is intended to be defined only by the claims that follow.

What is claimed is:

1. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine, a mounting plate having at least one opening defining an inner dimension for receiving a fastener having an outer dimension smaller than the inner dimension of the at least one opening, the propulsion unit assembly being mounted to the front wall of the tunnel, and one or more positioning bosses formed within said tunnel, the one or more positioning bosses being located so as to align the propulsion unit assembly at a predetermined orientation with respect to the longitudinal axis of the watercraft.

2. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine, the propulsion unit assembly being mounted to the front wall of the tunnel, and one or more positioning bosses formed within said tunnel, the one or more positioning bosses being located so as to align the propulsion unit assembly at a predetermined orientation with respect to the longitudinal axis of the watercraft, the propulsion unit assembly additionally comprising a mounting plate extending across at least a portion of the tunnel proximate the propulsion device, the one or more positioning bosses being arranged to cooperate with the mounting plate and comprise a vertical positioning boss and a horizontal positioning boss, the vertical positioning boss defining a predetermined vertical position of the mounting plate relative to the tunnel, and the horizontal positioning boss defining a predetermined transverse position of the mounting plate relative to the tunnel, whereby the mounting plate can be positioned at a predetermined position within the tunnel by contacting the vertical and horizontal positioning bosses.

3. The small watercraft of claim 2, wherein the mounting plate comprises a pair of orthogonally oriented stoppers that are arranged on the mounting plate at positions corresponding to the vertical and horizontal positioning bosses of the hull such that, with the stoppers contacting the positioning bosses, the mounting plate is in a predetermined orientation relative to the hull of the watercraft.

4. The small watercraft of claim 3, wherein the bosses are formed on the front wall of the tunnel.

5. The small watercraft of claim 2, wherein the bosses on the hull are arranged at a position above a rotational axis of the propulsion device.

6. The small watercraft of claim 2, wherein the mounting plate comprises a plurality of stiffening ribs.

7. The small watercraft of claim 2 additionally comprising a cooling water conduit communicating with the propulsion device and integrally formed with the propulsion unit assembly.

8. The small watercraft of claim 7, wherein at least a portion of the cooling water conduit is defined between the mounting plate and a portion of a housing for the propulsion device.

9. The small watercraft of claim 7, wherein at least a portion of the cooling water conduit is integrally formed with a housing of the propulsion device.

10. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine, the propulsion unit assembly being mounted to the front wall of the tunnel, and one or more positioning bosses formed within said tunnel, the one or more positioning bosses being located so as to align the propulsion unit assembly at a predetermined orientation with respect to the longitudinal axis of the watercraft, wherein the one or more positioning bosses comprise a vertical positioning boss and a horizontal positioning boss, and the vertical and horizontal positioning bosses are located such that a rotational axis of the propulsion device is positioned essentially parallel to the longitudinal axis of the watercraft when aligned by the positioning bosses.

11. The small watercraft of claim 10, wherein the propulsion unit assembly further comprises a mounting plate, and the mounting plate is mounted to the front wall of the tunnel with the propulsion device mounted to the mounting plate.

12. The small watercraft of claim 11, wherein the mounting plate further comprises one or more stoppers formed on the mounting plate, the one or more stoppers positioned on the mounting plate such that, when the one or more stoppers are in contact with the one or more positioning bosses, the mounting plate is in a predetermined orientation relative to the hull of the watercraft.

13. The small watercraft of claim 11, wherein the mounting plate comprises a plurality of mounting bosses interconnected by a plurality of ribs.

14. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine, the propulsion unit assembly being mounted to the front wall of the tunnel, and one or more positioning bosses formed within said tunnel, the one or more positioning bosses being located so as to align the propulsion unit assembly at a predetermined orientation with respect to the longitudinal axis of the watercraft, wherein the one or more positioning bosses comprise a plurality of vertical positioning bosses and a plurality of horizontal positioning bosses.

15. The small watercraft of claim 14, wherein the plurality of vertical and horizontal positioning bosses are located such that the rotational axis of the propulsion device is positioned essentially parallel to the longitudinal axis of the watercraft.

16. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine, the propulsion unit assembly being mounted to the front wall of the tunnel, and one or more positioning bosses formed within said tunnel, the one or more positioning bosses being located so as to align the propulsion unit assembly at a predetermined orientation with respect to the longitudinal axis of the watercraft, wherein the one or more positioning bosses are formed on the front wall of the tunnel.

17. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine, the propulsion unit assembly including a mounting plate mounted to the front wall of the tunnel, the mounting plate including at least one opening defining an inner dimension for receiving at least one fastener having an outer dimension smaller than the inner dimension of the at least one opening, and positioning means operating between the mounting plate and the hull to provide the propulsion unit assembly at a predetermined orientation with respect to the longitudinal axis of the watercraft.

18. The small watercraft of claim 17, wherein the positioning means are formed on the front wall of the tunnel.

19. The small watercraft of claim 17, wherein the positioning means are arranged at a position above a rotational axis of the propulsion device.

20. The small watercraft of claim 17, wherein the mounting plate comprises a plurality of stiffening ribs.

21. The small watercraft of claim 17 additionally comprising a cooling water conduit communicating with the propulsion device and integrally formed with the propulsion unit assembly.

22. The small watercraft of claim 21, wherein at least a portion of the cooling water conduit is defined between the mounting plate and a portion of a housing for the propulsion device.

23. The small watercraft of claim 21, wherein at least a portion of the cooling water conduit is integrally formed with a housing of the propulsion device.

24. A small watercraft comprising a hull having a longitudinal axis, an engine compartment defined within the hull, an engine mounted within the engine compartment, a tunnel defined on an underside of the hull, the tunnel having a front wall, a propulsion unit powered by the engine, the propulsion unit mounted to the front wall of the tunnel, the propulsion unit defining a pressurization chamber, a plate covering at least a portion of the tunnel proximate the propulsion unit, a cooling water supply system having a passage at least partially formed integrally with the walls of the propulsion unit, the passage having an inlet communicating with and extending from the pressurization chamber, the passage having an opening positioned downstream from the inlet, and a removable closure plate sealing the opening.

25. The small watercraft of claim 24, wherein the integrally formed passage extends longitudinally within the walls of the propulsion unit.

26. The small watercraft of claim 24, wherein the cooling water supply system comprises a coolant inlet housing in fluid communication with the interior of the propulsion unit.

27. The small watercraft of claim 26, wherein a filter is disposed within the coolant inlet housing and forms at least a portion of one of the walls of the propulsion unit, and a removable closure plate is attached to the coolant inlet housing and holds the filter in place.

28. The small watercraft of claim 27, wherein the filter has a box-like shape with a plurality of filter holes defined on a side of the filter in direct communication with the interior of the propulsion unit.

29. The small watercraft of claim 26, wherein the coolant inlet housing is connected to the propulsion unit aft of an impeller of the propulsion unit.

30. The small watercraft of claim 24, wherein the propulsion unit comprises a pump housing assembly and a pressurization chamber housing, each housing including an external conduit section integrally formed with the housing and communicating with each other so as to define at least a section of the integrally formed passage.

31. The small watercraft of claim 24 additionally comprising one or more positioning bosses formed within said tunnel, the one or more positioning bosses being located so as to align the propulsion unit at a predetermined orientation with respect to the longitudinal axis of the watercraft.

32. The small watercraft of claim 31, wherein at least a portion of the passage is formed between the mounting plate and the housing assembly.

33. A small watercraft comprising a hull having a longitudinal axis, an engine compartment defined within the hull, an engine mounted within the engine compartment, a tunnel defined on an underside of the hull, the tunnel having a front wall, a propulsion unit powered by the engine and having a plurality of walls, the propulsion unit mounted to the front wall of the tunnel, a plate covering at least a portion of the tunnel proximate the propulsion unit, and a cooling water supply system having a passage at least partially formed integrally with the walls of the propulsion unit, wherein at least a portion of the cooling water conduit is defined between the mounting plate and a portion of a housing for the propulsion device.

34. A small watercraft comprising a hull having a longitudinal axis, an engine compartment defined within the hull, an engine mounted within the engine compartment, a tunnel defined on an underside of the hull, the tunnel having a front wall, a propulsion unit powered by the engine, the propulsion unit having a housing assembly formed by a plurality of walls, the propulsion unit being mounted to a mounting plate attached to the front wall of the tunnel, and a cooling water supply system having a passage formed integrally within the walls of the propulsion unit and extending through the front wall of the tunnel.

35. The small watercraft of claim 34, wherein the portion of the passage that is formed in part by the mounting plate extends generally normal to a rotational axis of the propulsion unit.

36. A small watercraft comprising a hull having a longitudinal axis, an engine compartment defined within the hull, an engine mounted within the engine compartment, a tunnel defined on an underside of the hull, the tunnel having a front wall, a propulsion unit assembly including a propulsion device driven by the engine and a mounting plate, means for adjustably mounting the mounting plate to the front wall of the tunnel and one or more positioning bosses formed on the mounting plate or the front wall of the tunnel, the one or more positioning bosses being located so as to align the propulsion unit assembly at a predetermined orientation with respect to the longitudinal axis of the watercraft, the one or more positioning bosses being separate from the means for adjustably mounting.

* * * * *